United States Patent [19]

Larws

[11] Patent Number: 4,582,496

[45] Date of Patent: Apr. 15, 1986

[54] SOCKETED BUILDING BLOCK

[76] Inventor: Peter Larws, Schlappmuhler Pfad 13, D-6390 Usingen, Fed. Rep. of Germany

[21] Appl. No.: 681,141

[22] Filed: Dec. 13, 1984

[30] Foreign Application Priority Data

Dec. 17, 1983 [EP] European Pat. Off. ..... 83112748.5

[51] Int. Cl.[4] ..... A63H 33/12

[52] U.S. Cl. ..... 446/104; 446/122; 446/124

[58] Field of Search ..... 446/85, 122, 123, 124, 446/125, 102, 104, 108

[56] References Cited

U.S. PATENT DOCUMENTS 3,365,198 1/1968 Hay ..... 446/85 X
3,613,291 10/1971 Howe ..... 446/124 X
3,838,535 10/1974 Larws ..... 446/124
4,376,351 3/1983 Larws ..... 446/124

FOREIGN PATENT DOCUMENTS 2547343 4/1977 Fed. Rep. of Germany ..... 446/123
694658 12/1930 France ..... 446/122

*Primary Examiner*—Mickey Yu
*Attorney, Agent, or Firm*—Barnes & Thornburg

[57] ABSTRACT

A toy building block is disclosed which is in the approximate shape of an "A" formed by two legs fixed to an apex portion which includes a square socket opening. Building blocks of this shape are joinable by an axle inserted into the apex opening the axle having either a square or circular cross section, all of the dimensions of the building blocks and axle being based on a basic unit of length a.

5 Claims, 6 Drawing Figures

SOCKETED BUILDING BLOCK

The present invention relates generally to construction toys of the type which employ building block elements which mate with each other to construct a wide variety of objects and devices. The invention particularly concerns building blocks which include a joining element which can be received in a socket opening so as to permit angular adjustment of the building blocks so joined. The invention has particular utility with building blocks in which the basic element is made in an H-shape such as is disclosed in my earlier U.S. Pat. No. 3,838,535. The present invention and my previously disclosed building blocks are dimensioned such that the whole building block system is based on a basic unit of length "a". The new socketed building blocks of the present invention include an opening with a cross section "a"×"a". They can be connected to each other by axles which are inserted through these socket openings.

There are already well-known jointed building blocks of other constructions which include means for connecting the blocks in an articulated manner. However, all of these have the disadvantage that the turnability of the joint is limited. The prior art building blocks do not permit the joint to be locked at specific selected angular positions in a simple manner. For example, there is a well-known joint unit for the building block of German Pat. No. 25 47 343 which can produce the approximate shape of an "A". This well-known building block includes a cardan shaft formed of a round-headed screw and multi-edged nut. This well-known joint is merely an additional piece which can also be used as a connecting piece but not as an independent building block.

An object of the present invention is to provide a building block that not only can be assembled with other building blocks in any desired angular position or locked at certain angles, but also can be used as an independent building element so that several of the building blocks pursuant to the present invention can be combined with others to create interesting figures. Above all, it should be possible to create at will either a movable or stationary combination with the building blocks pursuant to the present invention.

A socketed building block of the present invention is characterized by all the dimensions of the block being based on a basic unit of length "a" and all multiples or even-numbered fractions of this basic unit length. The building block assembly consists of two uniform socketed building units having the approximate shape of an "A". That is, each unit includes two legs which are fixed to an apex. The greatest unit of length of each element is 3*a*. The greatest width is 2*a*. The width of each leg is a/2. The depth of the unit in the leg area is a. The depth in the apex area is a/2. A square socket opening with a cross section of a×a is provided in the apex area to receive an axle which can be inserted through the socket opening of two related elements.

The optional turnability of the individual elements with respect to each other or the locking of these elements in a certain angular position is achieved by connecting the elements to each other by an axle with a circular outer contour or by an axle with a square outer contour, respectively. Since the opening in the elements in the socket area is square, one can choose to use an axle with a circular outer contour to provide infinite variability of position. The use of an axle with a square outer contour results in a rigid combination of the related socket elements at a defined angular relationships.

Additional features and advantages of the invention will become apparent to those skilled in the art upon consideration of the following detailed description of a preferred embodiment exemplifying the best mode of carrying out the invention as presently perceived. The detailed description particularly refers to the accompanying figures in which.

Figure 1:
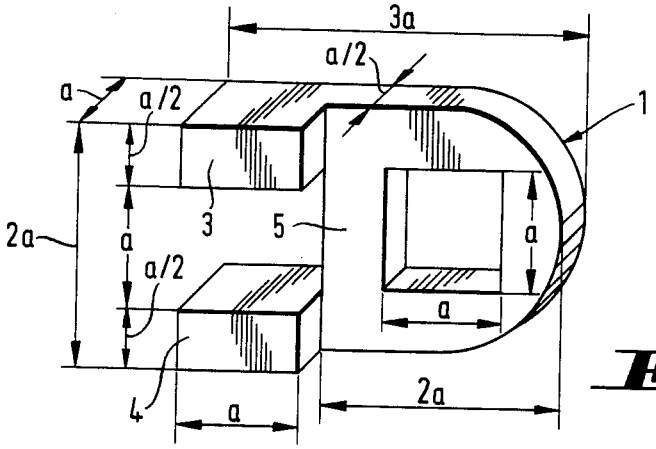
FIG. 1 shows a perspective view of a socketed building element in accordance with the present invention.

The socketed building block 1 shown in FIG. 1 has the approximate shape of an "A". The building block includes an apex section 5 and two legs 3 and 4 extending from the apex section 5. The building block is dimensioned on a basic unit of length "a". That is, the greatest length of the building block is 3*a*, while its greatest width is 2*a*. Its depth in the region of legs 3 and 4 is a. Its depth is in the region of the apex 5 is a/2. The length of leg 3 and 4 is a. The width of each leg 3 and 4 is a/2. The length of the apex section 5 is 2*a*. The apex section 5 includes a square socket of the dimensions a×a.

Figure 2:
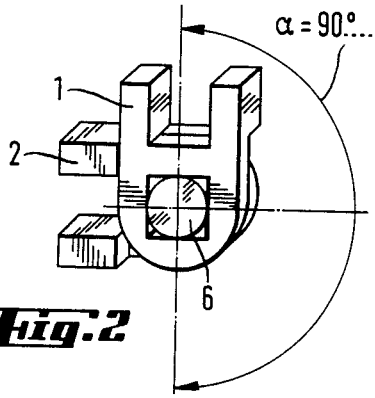
FIG. 2 shows one possible combination of a pair of such socketed elements by the use of an axle with a circular cross section.

FIG. 2 shows two building block elements 1 and 2 both having the shape as shown in FIG. 1 joined together by an axle 6 having a circular cross section of diameter a. The two building blocks 1 and 2 are joined together such that the depth sections of the legs 3 and 4 interact with the sides of the building element to restrict rotation of the elements through an arc of only 180° ($\alpha = 90° - 270°$).

Figure 3:
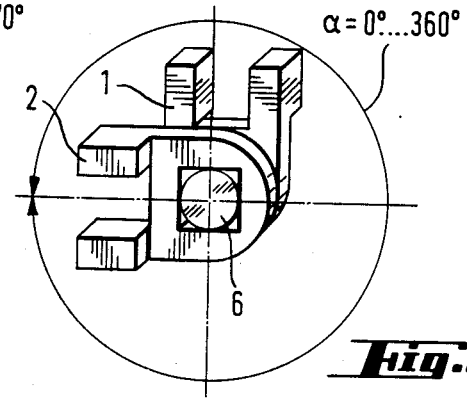
FIG. 3 shows an alternate combination of two building blocks of the present invention using an axle with a circular cross section.

In FIG. 3, the same two building blocks 1 and 2 are connected by the same circular cross section axle 6 but in such a manner that the angular rotation of the building blocks with respect to each other is unrestricted by the depth dimension of the legs 3 and 4, thus permitting a full 360° rotation of the blocks with respect to each other.

Figure 4:
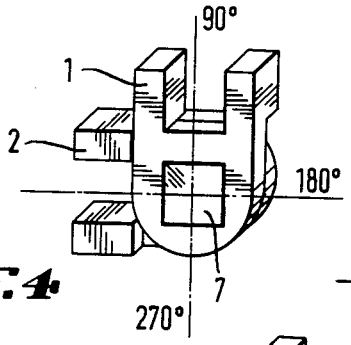
FIG. 4 shows one possible combination of a building block of the present invention employing an axle with a square cross section.
Figure 5:
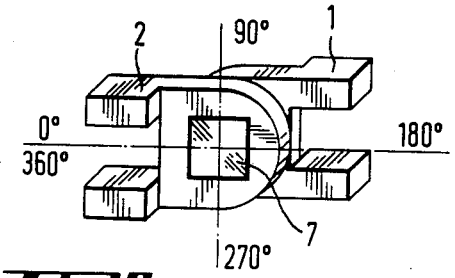
FIG. 5 shows an alternate combination of the building blocks of the present invention using an axle having a square cross section.

FIGS. 4 and 5 show two possibilities for the combination of two such building blocks of the present invention using an axle 7 having a square cross section a×a. The use of an axle with a square outer contour results in a rigid combination of both socket elements at an angle according to FIG. 4 of $\alpha = 90°$, or $\alpha = 180°$, or $\alpha = 270°$. Using the combination from FIG. 5, angles of $\alpha = 0°$ or 360° respectively or $\alpha = 90°$, or $\alpha = 180°$, or $\alpha = 270°$ result.

Figure 6:
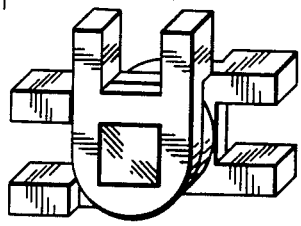
FIG. 6 is a perspective view showing the combination of more than two building elements on a common axle.

The socket and elements of the present invention can also be used with the various building blocks of my earlier U.S. Pat. Nos. 3,838,535 and 4,376,351. Alternatively, the blocks of the present invention can be used solely with each other to make their own figures without the use of any other preshaped building blocks other than axles such as 6 and 7 having circular and square cross sections respectively. Any number of building blocks may be assembled to arrive at various shapes for objects and devices as shown in FIG. 6.

Although the invention has been described in detail with reference to the illustrated preferred embodiment, certain variations and modifications exist within the scope and spirit of the invention as described and defined in the following claims.

What is claimed is:

1. A socketed building block having the approximate shape of an "A" and comprising two legs fixed to an apex section, the apex section including a square aperture, all dimensions of the building block being based on a basic unit of length "a" and multiples and even-numbered fractions thereof, and wherein the greatest length of the building block is "3*a*", the greatest width is "2*a*", the width of each leg is "a/2", the depth in the area of each leg is "a", the depth in the area of the apex is "a/2", and the cross-section of the square opening in the apex section is "a"×"a".

2. A building block assembly comprising at least two identical building elements, each element having the approximate shape of an "A" formed by two legs joined to an apex section which includes an opening, each element having dimensions which are based on a basic unit of length "a" and multiples or even-numbered fractions thereof, and wherein the greatest length of each element is "3*a*", the greates width is "2*a*", the width of each leg is "a/2", the depth of each element in the area of each leg is "a", and the depth of each element in the area of the apex is "a/2", and the opening in the apex section has a square cross-section of "a"×"a".

3. The building block assembly of claim 2 further comprising an axle inserted through the openings in the apex sections of at least two of the elements.

4. The building block assembly of claim 3 wherein the axle has a circular cross section having diameter "a".

5. The building block assembly of claim 3 wherein the axle has a square cross section of "a"×"a".

* * * * *

UNITED STATES PATENT AND TRADEMARK OFFICE

CERTIFICATE OF CORRECTION

PATENT NO. : 4,582,496

DATED : April 15, 1986

INVENTOR(S) : Peter Larws

It is certified that error appears in the above-identified patent and that said Letters Patent is hereby corrected as shown below:

In Column 4, line 10, replace "greates" with -- greatest --.

Signed and Sealed this

*Nineteenth* Day of *August 1986*

[SEAL]

*Attest:*

*Attesting Officer*

DONALD J. QUIGG

*Commissioner of Patents and Trademarks*